US012490868B2

(12) United States Patent
Mao et al.

(10) Patent No.: US 12,490,868 B2
(45) Date of Patent: Dec. 9, 2025

(54) ROTATABLE BATH CHAIR

(71) Applicant: Zhongshan Bliss Medical Instrument Co., Ltd, Guangdong (CN)

(72) Inventors: Jiawang Mao, Guangdong (CN); Runxuan Wang, Guangdong (CN)

(73) Assignee: Zhongshan Bliss Medical Instrument Co., Ltd, Zhongshan (CN)

( * ) Notice: Subject to any disclaimer, the term of this patent is extended or adjusted under 35 U.S.C. 154(b) by 79 days.

(21) Appl. No.: 18/665,863

(22) Filed: May 16, 2024

(65) Prior Publication Data

US 2025/0295275 A1 Sep. 25, 2025

(30) Foreign Application Priority Data

Mar. 25, 2024 (CN) ..... 202420594078.X

(51) Int. Cl.
*A47K 3/12* (2006.01)
*A47C 3/18* (2006.01)
*A47C 3/34* (2006.01)

(52) U.S. Cl.
CPC ..... *A47K 3/122* (2013.01); *A47C 3/18* (2013.01); *A47C 3/34* (2013.01)

(58) Field of Classification Search
CPC ..... A47K 3/122; A47K 3/282; A47C 3/18; A47C 3/34
USPC .... 4/560.1, 562.1, 571.1, 573.1, 578.1, 604, 4/611
See application file for complete search history.

(56) References Cited

U.S. PATENT DOCUMENTS 5,822,809 A * 10/1998 Gallo ..... A47K 3/122 4/578.1
5,903,935 A * 5/1999 Huelke ..... A47K 3/122 4/578.1
2009/0025136 A1* 1/2009 Cheng ..... A47K 3/122 4/560.1
2025/0107669 A1* 4/2025 Zhang ..... A47K 3/122

FOREIGN PATENT DOCUMENTS

CN 112205905 A * 1/2021 ..... A47K 3/122

* cited by examiner

*Primary Examiner* — Tuan N Nguyen
(74) *Attorney, Agent, or Firm* — Falcon Rappaport & Berkman LLP

(57) ABSTRACT

A rotatable bath chair is disclosed, including a tripod assembly, a seat assembly and a rotating mechanism. The seat assembly is located above the tripod assembly. The rotating mechanism is arranged between the tripod assembly and the seat assembly, and includes a rotating base, a rotating shaft, an upper limit member and a first plane support assembly. The upper limit member is connected to an upper end of the rotating shaft, and is arranged on the seat assembly. The rotating base is arranged on the tripod assembly, and the rotating shaft passes through the rotating base in a vertical direction. The first plane support assembly is arranged between the upper limit member and the rotating base, and includes a first upper ring, a first rolling member and a first lower ring which are arranged vertically.

10 Claims, 4 Drawing Sheets

Fig. 5

ROTATABLE BATH CHAIR

CROSS-REFERENCE TO RELATED APPLICATIONS

This application claims priority to Chinese patent application No. 202420594078.X filed Mar. 25, 2024. The content of the application is incorporated herein by reference in their entirety.

TECHNICAL FIELD

The present disclosure relates to the field of bath chairs, in particular to a rotatable bath chair.

BACKGROUND

The elderly or infirm need to use a bath chair when taking a bath. Some existing rotatable bath chairs include a tripod assembly, a seat assembly, and a rotating mechanism, the existing rotatable bath chairs generally adopt a rotating structure similar to that of a dining table turntable, including an inner ring and an outer ring. The inner ring is fixed to the seat assembly, and the outer ring is fixed to the tripod assembly. Balls are arranged between the outer peripheral wall of the inner ring and the inner peripheral wall of the outer ring, so as to meet the requirements of smooth rotation. However, in actual applications, when a user sits on the seat assembly, a large downward pressure will be formed, causing the inner ring to press against the upper part of the tripod assembly or the outer ring to press against the bottom surface of the seat assembly. The above structure of the existing rotatable bath chairs increases the friction resistance, reduces the smoothness of rotation, and results in an inconvenient use.

SUMMARY

The present disclosure aims to solve at least one of the technical problems in the existing technology. To this end, the present disclosure provides a rotatable bath chair with smooth rotation of chair back assemblies.

A rotatable bath chair according to an embodiment of the present disclosure includes a tripod assembly, a seat assembly, and a rotating mechanism. The seat assembly is located above the tripod assembly. The rotating mechanism is arranged between the tripod assembly and the seat assembly, and includes a rotating base, a rotating shaft, an upper limit member and a first plane support assembly. The upper limit member is connected to an upper end of the rotating shaft, and is arranged on the seat assembly. The rotating base is arranged on the tripod assembly, and the rotating shaft passes through the rotating base in a vertical direction. The first plane support assembly is arranged between the upper limit member and the rotating base, and includes a first upper ring, a first rolling member and a first lower ring which are arranged vertically. The first upper ring abuts against the upper limit member, the first lower ring abuts against the rotating base, and the first rolling member is arranged between the first upper ring and the first lower ring.

The rotatable bath chair according to an embodiment of the present disclosure has at least the following beneficial effects.

By arranging the first plane support assembly between the upper limit member and the rotating base, the first plane support assembly provides an axial force to support the positions of the upper limit member and the chair back assembly relative to the rotating base and the tripod assembly, and to reduce the contact force between the upper limit member and the upper end of the rotating base. On this basis, the friction between the upper limit member and the upper end of the rotating base is reduced when the chair back assembly rotates. Moreover, the first upper ring and the first lower ring are in rolling connection by means of the first rolling member to reduce the friction, thereby enabling smooth rotation of the chair back assembly and improving the use experience.

According to some embodiments of the present disclosure, the upper limit member is spaced apart from an upper end of the rotating base.

According to some embodiments of the present disclosure, the rotating base has an upper part provided with an upper accommodating hole, the upper accommodating hole has a hole axis arranged in the vertical direction, the first plane support assembly is arranged in the upper accommodating hole, the first lower ring abuts against a bottom of the upper accommodating hole, and the upper accommodating hole has a depth less than an axial dimension of the first plane support assembly.

According to some embodiments of the present disclosure, the rotating mechanism includes a lower limit member and a second plane support assembly. The lower limit member is located below the rotating base and connected to the rotating shaft. The second plane support assembly is arranged between the lower limit member and the rotating base, and includes a second upper ring, a second rolling member, and a second lower ring which are arranged vertically. The second upper ring abuts against the rotating base, the second lower ring abuts against the lower limit member, and the second rolling member is arranged between the second upper ring and the second lower ring.

According to some embodiments of the present disclosure, the lower limit member is spaced apart from a lower end of the rotating base.

According to some embodiments of the present disclosure, the rotating base has a lower part provided with a lower accommodating hole, the lower accommodating hole has a hole axis arranged in the vertical direction, the second plane support assembly is arranged in the lower accommodating hole, the second upper ring abuts against a bottom of the lower accommodating hole, and the lower accommodating hole has a depth less than an axial dimension of the second plane support assembly.

According to some embodiments of the present disclosure, the rotating mechanism includes a first locking pin and a first elastic member. The rotating base is provided with at least two locking slots at outer side thereof and around a rotating axis of the rotating shaft. The first locking pin is slidably arranged below the upper limit member and is capable of being inserted into or pulled out of the locking slots. The first elastic member is arranged between the first locking pin and the upper limit member and is capable of driving the first locking pin to press against the outer side of the rotating base.

According to some embodiments of the present disclosure, the tripod assembly includes a tripod main body, a sliding table, and a positioning mechanism. The tripod main body is provided with at least one guide tube, and the sliding table is provided with a guide assembly in one-to-one sliding fit with the guide tube. The guide assembly includes a sliding sleeve and at least two sliding fittings, and the at least two sliding fittings are spaced apart from each other in the sliding sleeve. The sliding fittings are provided with through holes in sliding fit with the guide tube, and the sliding fittings are arranged with a spacing area formed therebetween. The positioning mechanism includes at least one second locking pin and at least one positioning hole. The positioning hole is arranged on the guide tube, the second locking pin is slidably arranged on the sliding sleeve and located in the spacing area, and the second locking pin is capable of being inserted into or pulled out of the positioning hole to lock or unlock a position of the sliding table relative to the tripod main body. The rotating mechanism is connected to the sliding table.

According to some embodiments of the present disclosure, the sliding fittings are linear bearings, and the guide assembly is provided with two sliding fittings, and the two sliding fittings are respectively arranged at opposite ends of the sliding sleeve.

According to some embodiments of the present disclosure, the positioning mechanism also includes a second elastic member, which is arranged between the second locking pin and the sliding sleeve and is capable of driving the second locking pin to press against an outer side of the guide tube.

Additional aspects and advantages of the present disclosure will be set forth in part in the description which follows, and in part will be obvious from the description, or can be learned by practice of the present disclosure.

BRIEF DESCRIPTION OF DRAWINGS

The above and/or additional aspects and advantages of the present disclosure will become apparent and readily understood from the description of the embodiments in conjunction with the following accompanying drawings, in which.

Figure 1:
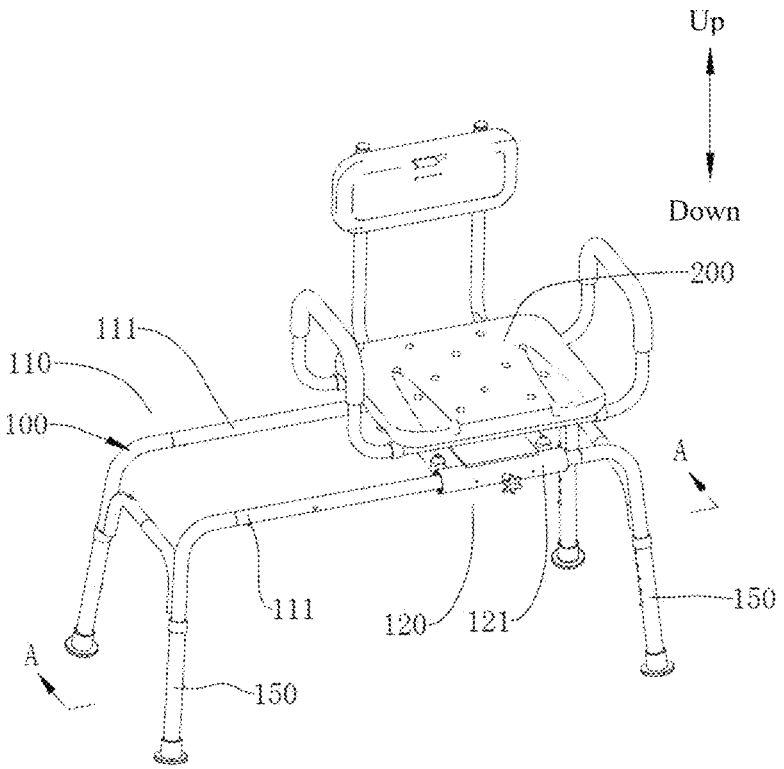
FIG. 1 is a three-dimensional schematic diagram of a bath chair according to an embodiment of the present disclosure.

REFERENCE NUMERALS tripod assembly 100, tripod main body 110, guide tube 111, sliding table 120, sliding sleeve 121, sliding fitting 122, mounting hole 123, positioning mechanism 130, second locking pin 131, positioning hole 132, second elastic member 133, locking pin guide tube 134, second handle 140, and leg 150;

seat assembly 200;

rotating mechanism 300, rotating base 310, upper accommodating hole 311, lower accommodating hole 312, locking slot 313, rotating shaft 320, upper limit member 330, first plane support assembly 340, first upper ring 341, first rolling member 342, first lower ring 343, lower limit member 350, second plane support assembly 360, second upper ring 361, second rolling member 362, second lower ring 363, first locking pin 370, first elastic member 380, and first handle 390.

DETAILED DESCRIPTION

Embodiments of the present disclosure will be described in detail below, and examples of the embodiments are shown in the accompanying drawings, where throughout the same or similar reference numerals denote the same or similar elements or elements having the same or similar functions. The following embodiments described with reference to the accompanying drawings are exemplary and serve only to explain the present disclosure, and should not be construed as limiting the present disclosure.

In the description of the present disclosure, it is to be understood that, referring to orientation description, the instructed orientation or positional relationships (for example, upper, lower, etc.,) are based on the orientation or positional relationships shown in the accompanying drawings. The orientation description is merely for ease of description of the present disclosure and simplification for the description, rather than indicating or implying that the device or element referred to must have a specific orientation and be constructed and operated in a specific orientation, it cannot be construed as limiting the present disclosure.

In the description of the present disclosure, "multiple" means "two or more". The description "first" and "second" are only for the purpose of distinguishing technical features, and not to be construed as indicating or implying relative importance, or implicitly indicating the number of technical features, or implicitly indicating the precedence relationship of technical features.

In the description of the present disclosure, unless explicitly defined otherwise, "providing", "mounting", "connecting" and other words should be understood broadly, and a person skilled in the art can reasonably determine the specific meaning of the above words in the present disclosure combined with the specific content of the technical solution.

The elderly or infirm need to use a bath chair when taking a bath. Some existing rotatable bath chairs include a tripod assembly 100, a seat assembly 200 and a rotating mechanism 300, the existing rotatable bath chairs generally adopt a rotating structure similar to that of a dining table turntable, including an inner ring and an outer ring. The inner ring is fixed to the seat assembly 200, and the outer ring is fixed to the tripod assembly 100. Balls are arranged between the outer peripheral wall of the inner ring and the inner peripheral wall of the outer ring, so as to meet the requirements of smooth rotation. However, in actual applications, when a user sits on the seat assembly 200, a large downward pressure will be formed, causing the inner ring to press against the upper part of the tripod assembly 100 or the outer ring to press against the bottom surface of the seat assembly 200. The above structure of the existing rotatable bath chairs increases the friction resistance, reduces the smoothness of rotation, and results in an inconvenient use.

Figure 2:
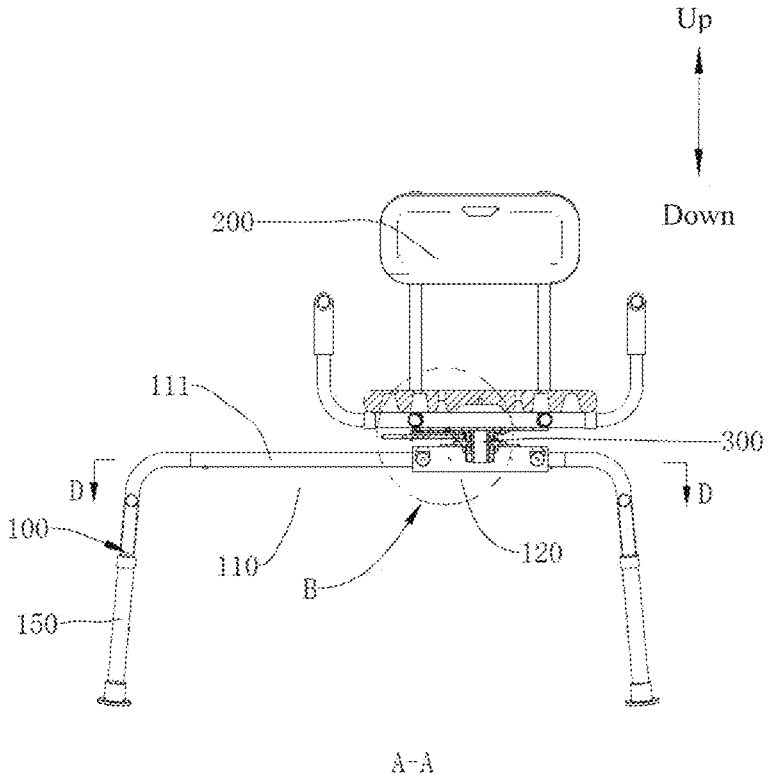
FIG. 2 is a schematic cross-sectional diagram in the A-A direction of FIG. 1 according to an embodiment of the present disclosure.
Figure 3:
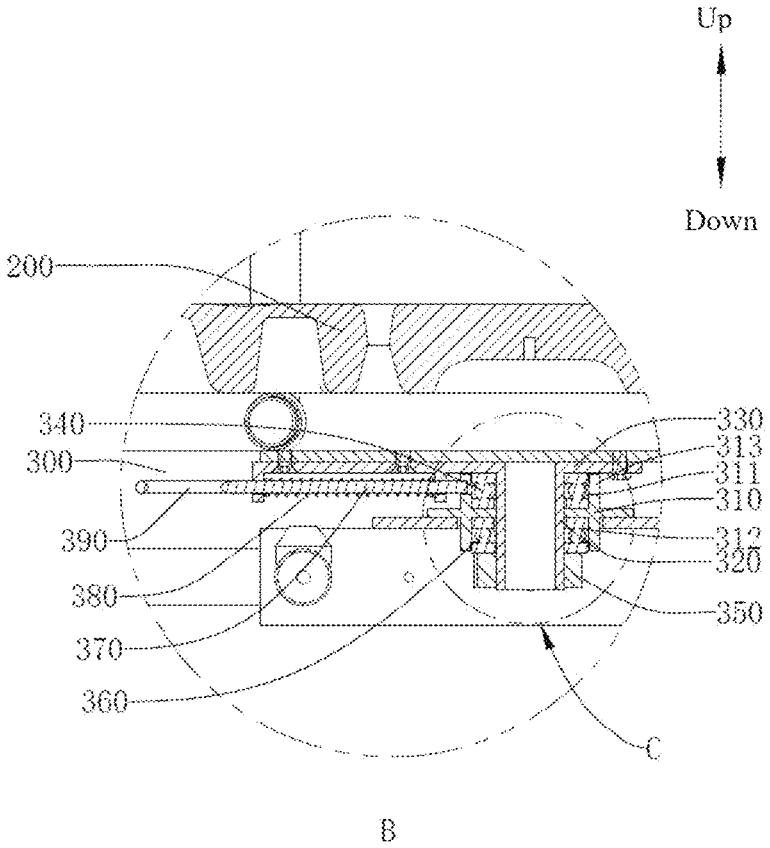
FIG. 3 is a partially enlarged schematic diagram of B in FIG. 2 according to an embodiment of the present disclosure.
Figure 4:
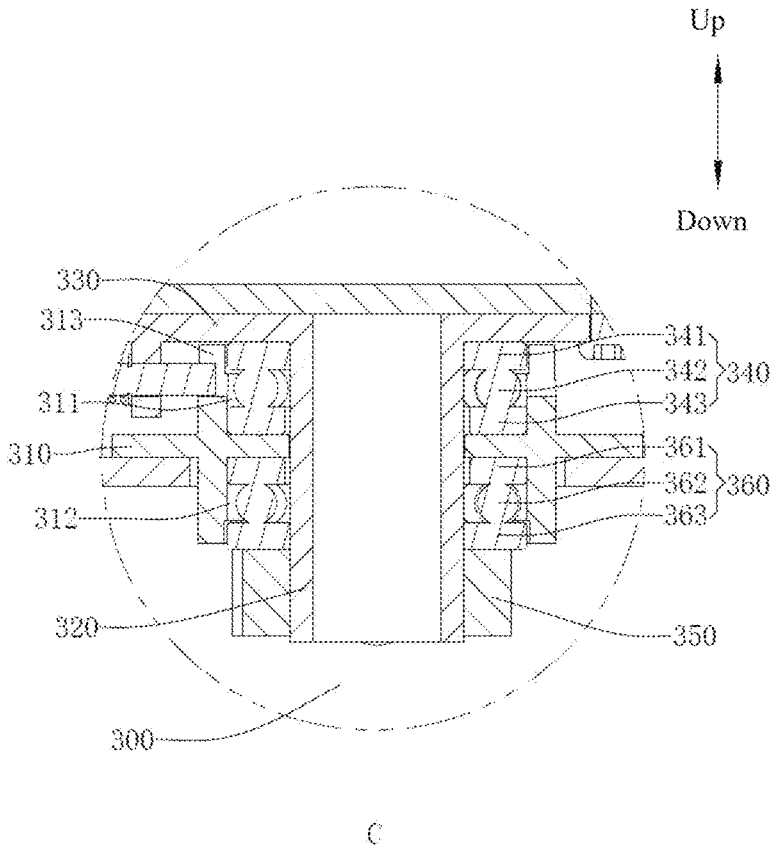
FIG. 4 is a partially enlarged schematic diagram of C in FIG. 3 according to an embodiment of the present disclosure.
Figure 5:
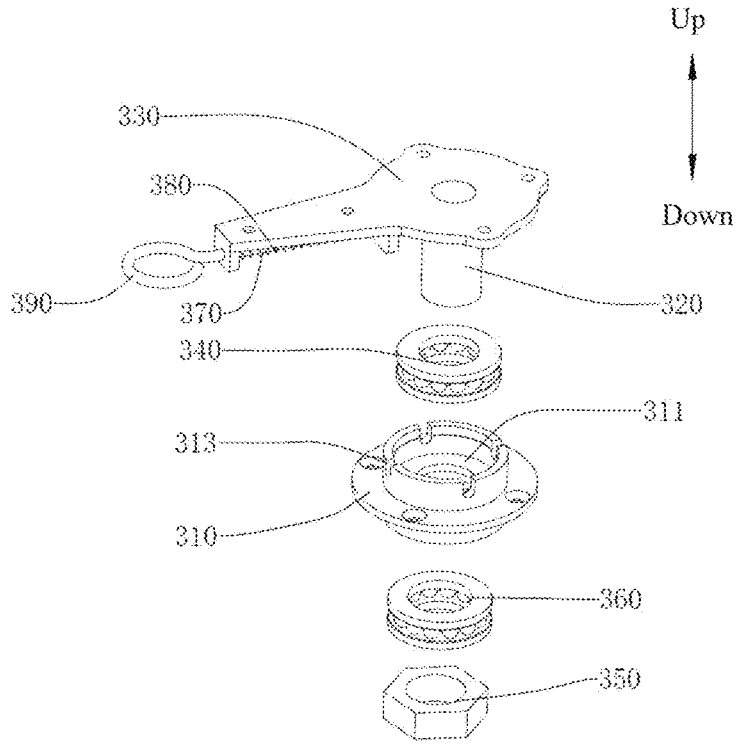
FIG. 5 is an exploded schematic diagram of a rotating mechanism according to an embodiment of the present disclosure.
Figure 6:
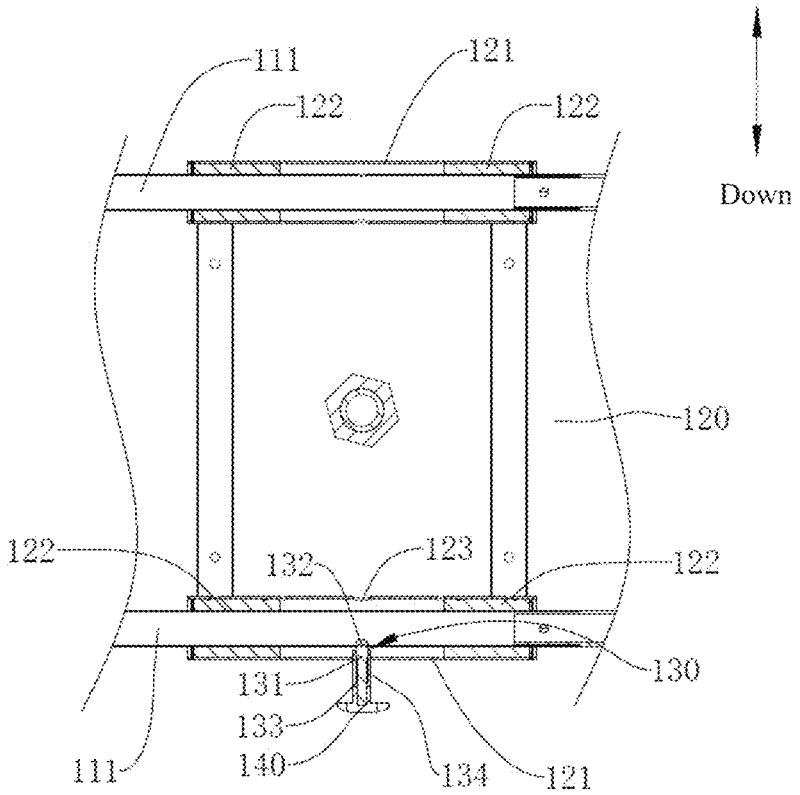
FIG. 6 is a partial schematic cross-sectional diagram in the D-D direction of FIG. 2 according to an embodiment of the present disclosure.

Referring to FIGS. 1 to 6, a rotatable bath chair according to an embodiment of the present disclosure includes a tripod assembly 100, a seat assembly 200 and a rotating mechanism 300. The seat assembly 200 is located above the tripod assembly 100. The rotating mechanism 300 is arranged between the tripod assembly 100 and the seat assembly 200, and includes a rotating base 310, a rotating shaft 320, an upper limit member 330 and a first plane support assembly 340. The upper limit member 330 is connected to an upper end of the rotating shaft 320, and is arranged on the seat assembly 200. The rotating base 310 is arranged on the tripod assembly 100, and the rotating shaft 320 passes through the rotating base 310 in a vertical direction. The first plane support assembly 340 is arranged between the upper limit member 330 and the rotating base 310, and includes a first upper ring 341, a first rolling member 342, and a first lower ring 343 which are arranged vertically. The first upper ring 341 abuts against the upper limit member 330, the first lower ring 343 abuts against the rotating base 310, and the first rolling member 342 is arranged between the first upper ring 341 and the first lower ring 343.

By arranging the first plane support assembly 340 between the upper limit member 330 and the rotating base 310, the first plane support assembly 340 provides an axial force to support the positions of the upper limit member 330 and the chair back assembly relative to the rotating base 310 and the tripod assembly 100 and to reduce the contact force between the upper limit member 330 and the upper end of the rotating base 310. On this basis, the friction between the upper limit member 330 and the upper end of the rotating base 310 is reduced when the chair back assembly rotates. Moreover, the first upper ring 341 and the first lower ring 343 are in rolling connection by means of the first rolling member 342 to reduce friction, thereby enabling smooth rotation of the chair back assembly and improving the use experience.

It can be understood that the first plane support assembly 340 can reduce part of the contact force between the upper limit member 330 and the rotating base 310, or can reduce all the contact force between the upper limit member 330 and the rotating base 310.

In an embodiment, the upper limit member 330 is spaced apart from an upper end of the rotating base 310, so that there is no direct contact between the upper limit member 330 and the rotating base 310. The rotating base 310 provides an axial force by means of the first plane support assembly 340 to support the chair back assembly, so as to reduce all the contact force between the upper limit member 330 and the rotating base 310, thereby enabling smoother rotation of the chair back assembly and less noise, and improving the use experience.

In an embodiment, an upper part of the rotating base 310 is provided with an upper accommodating hole 311, the upper accommodating hole 311 has a hole axis arranged in the vertical direction, the first plane support assembly 340 is arranged in the upper accommodating hole 311, the first lower ring 343 abuts against a bottom of the upper accommodating hole 311, and the upper accommodating hole 311 has a depth less than an axial dimension of the first plane support assembly 340. The upper accommodating hole 311 is arranged to accommodate part of the first plane support assembly 340, making the axial structure of the rotating mechanism 300 more compact. Moreover, the axial dimension of the first plane support assembly 340 is greater than the depth of the upper accommodating hole 311, so that the upper limit member 330 and the upper end of the rotating base 310 can be spaced apart from each other. The hole wall of the upper accommodating hole 311 also functions as a protective cover for the first plane support assembly 340, so as to avoid the risk of water or detergent splashing into the first plane support assembly 340 during bathing and thus affecting the service life of the first plane support assembly 340, thereby making the bath chair durable.

Specifically, the first plane support assembly 340 is a thrust ball bearing among planar thrust bearings, which has a relatively good use effect and can be directly purchased as a standard part. The first rolling member 342 is a ball. It is conceivable that the first plane support assembly 340 can also be other structures which provide an axial support force, such as thrust spherical roller bearings, tapered roller bearings, thrust roller bearings, four-point contact ball bearings, thrust cylindrical roller bearings, thrust needle roller bearings or thrust tapered roller bearings, or other structures which provide an axial thrust. On this basis, the first rolling member 342 can be specifically configured by a person skilled in the art according to actual needs.

Specifically, an outer peripheral wall of the first lower ring 343 is in tight fitting with the hole wall at the lower end of the upper accommodating hole 311, so that the first lower ring 343 can be mounted and fixed on the upper accommodating hole 311. One end of the upper accommodating hole 311 near the opening is provided with an expanded hole portion, and the upper accommodating hole 311 is in the shape of a stepped hole, so that the outer peripheral wall of the first upper ring 341 is spaced apart from the hole wall of the expanded hole portion of the upper accommodating hole 311. The inner hole of the first upper ring 341 is in tight fitting with the rotating shaft 320. The above structure facilitates the mounting of the first plane support assembly 340 into the upper accommodating hole 311, and can radially limit the rotating shaft 320 to facilitate the rotation of the rotating shaft 320 relative to the rotating base.

It is conceivable that in some embodiments, the lower part of the first plane support assembly 340 can also be placed directly on the upper end surface of the rotating base 310, so that the upper limit member 330 is spaced apart from the upper end of the rotating base 310, which can be specifically configured by a person skilled in the art according to actual needs.

Specifically, the upper limit member 330 is a plate body, and the rotating shaft 320 and the upper limit member 330 are an integral piece. It is conceivable that the upper limit member 330 and the rotating shaft 320 can also be two parts assembled with each other, and the upper limit member 330 can also be a nut connected to the upper end of the rotating shaft 320 in a threaded manner.

In the embodiment, the rotating mechanism 300 also includes a lower limit member 350 and a second plane support assembly 360. The lower limit member 350 is located below the rotating base 310 and connected to the rotating shaft 320. The second plane support assembly 360 is arranged between the lower limit member 350 and the rotating base 310, and includes a second upper ring 361, a second rolling member 362 and a second lower ring 363 which are arranged vertically. The second upper ring 361 abuts against the rotating base 310, the second lower ring 363 abuts against the lower limit member 350, and the second rolling member 362 is arranged between the second upper ring 361 and the second lower ring 363. The upper limit member 330 and the lower limit member 350 jointly limit the vertical position of the rotating shaft 320 relative to the rotating base 310. In general, the upper limit member 330 and the lower limit member 350 clamp the rotating base 310, so that the seat assembly 200 will not rock up and down. Therefore, there is usually a large friction force between the lower limit member 350 and the lower end of the rotating base 310, which results in requirements of a relatively large force to rotate the chair back assembly, and results in a large noise affecting the use experience. Accordingly, the second plane support assembly 360 is further provided to reduce the contact force between the lower limit member 350 and the lower end of the rotating base 310, and the friction force and noise are relatively reduced when the second plane support assembly 360 is used. On this basis, the chair back assembly can be rotated with a relatively small force, and the noise generated when the chair back assembly is rotated is further reduced, thereby improving the use experience of the bath chair.

It can be understood that the second plane support assembly 360 can reduce part of the contact force between the lower limit member 350 and the rotating base 310, or can reduce all the contact force therebetween.

Specifically, the upper limit member 330 is connected to the chair back assembly by means of screw locking, so that the upper limit member 330 is fixed to the chair back assembly. It is conceivable that the upper limit member 330 can also be connected to the chair back assembly by means of welding or riveting.

Specifically, the chair back assembly includes a seat cushion, armrests connected to opposite sides of the seat cushion, and a chair back connected to a rear side of the seat cushion. The seat cushion is provided with a plurality of drainage holes to drain accumulated water on the seat cushion conveniently and quickly.

In an embodiment, the lower limit member 350 is spaced apart from a lower end of the rotating base 310, so that the lower limit member 350 is no longer in direct contact with the lower end of the rotating base 310, thereby reducing all the contact force between the lower limit member 350 and the lower end of the rotating base 310. Since the friction force and noise are relatively reduced when the second plane support assembly 360 is used, the force required to rotate the chair back assembly is minimized, and the noise when the seat back assembly is rotated is minimized.

In an embodiment, a lower part of the rotating base 310 is provided with a lower accommodating hole 312, the lower accommodating hole 312 has a hole axis arranged in the vertical direction. The second plane support assembly 360 is arranged in the lower accommodating hole 312, the second upper ring 361 abuts against a bottom of the lower accommodating hole 312, and the lower accommodating hole 312 has a depth less than the axial dimension of the second plane support assembly 360. The lower accommodating hole 312 is arranged to accommodate part of the second plane support assembly 360, which results in making the axial structure of the rotating mechanism 300 compact. In addition, the axial dimension of the second plane support assembly 360 is greater than the depth of the lower accommodating hole 312, so that the lower limit member 350 and the lower end of the rotating base 310 can be spaced apart from each other. The hole wall of the lower accommodating hole 312 also functions as a protective cover for the second plane support assembly 360, so as to avoid the risk of water or detergent splashing into the second plane support assembly 360 during bathing and thus affecting the service life of the second plane support assembly 360, thereby making the bath chair durable.

Specifically, the second plane support assembly 360 is a thrust ball bearing among planar thrust bearings, which has a relatively good use effect and can be directly purchased as a standard part. The second rolling member 362 is a ball. It is conceivable that the second plane support assembly 360 can also be other structures which provide an axial support force, such as thrust spherical roller bearings, tapered roller bearings, thrust roller bearings, four-point contact ball bearings, thrust cylindrical roller bearings, thrust needle roller bearings or thrust tapered roller bearings, or other structures which provide an axial thrust. On this basis, the first rolling member 342 can be configured by a person skilled in the art according to actual needs.

Specifically, the outer peripheral wall of the second upper ring 361 is in tight fitting with the hole wall at the upper end of the lower accommodating hole 312, so that the second upper ring 361 can be mounted and fixed on the lower accommodating hole 312. One end of the lower accommodating hole 312 near the opening is provided with an expanded hole portion, and the lower accommodating hole 312 is in the shape of a stepped hole, so that the outer peripheral wall of the second lower ring 363 is spaced apart from the hole wall of the expanded hole portion of the lower accommodating hole 312. The inner hole of the second lower ring 363 is in tight fitting with the rotating shaft 320. The above structure facilitates the mounting of the second plane support assembly 360 into the lower accommodating hole 312, and can radially limit the rotating shaft 320 to facilitate the rotation of the rotating shaft 320 relative to the rotating base.

It is conceivable that in some embodiments, the upper part of the second plane support assembly 360 can also directly abut against the lower end surface of the rotating base 310, so that the lower limit member 350 is spaced apart from the lower end of the rotating base 310, which can be specifically configured by a person skilled in the art according to actual needs.

Specifically, the lower limit member 350 is a nut, which is connected to the lower part of the rotating shaft 320 in a threaded manner. The upper limit member 330 and the lower limit member 350 clamp the rotating base 310 by means of the first plane support assembly 340 and the second plane support assembly 360, thereby firmly restricting the up and down positions of the seat assembly 200 to prevent it from shaking easily. It is conceivable that the lower limit member 350 can also be a blocking ring or other limiting structure, which can be specifically configured by a person skilled in the art according to actual needs.

In an embodiment, the rotating mechanism 300 also includes a first locking pin 370 and a first elastic member 380. The rotating base 310 is provided with at least two locking slots 313 at outside thereof and around a rotating axis of the rotating shaft 320. The first locking pin 370 is slidably arranged below the upper limit member 330 and can be inserted into or pulled out of the locking slots 313. The first elastic member 380 is arranged between the first locking pin 370 and the upper limit member 330 and can drive the first locking pin 370 to press against the outer side of the rotating base 310. By providing the first locking pin 370 and the first elastic member 380, when the first locking pin 370 is inserted into the locking slots 313 of the rotating base 310, the first locking pin 370 limits the rotation of the upper limit member 330 relative to the rotating base 310, so that the seat assembly 200 cannot rotate. When it is necessary to rotate the seat assembly 200, the user can pull the first locking pin 370 out of one locking slot 313, and then rotate the chair back assembly. During this period, after releasing the first locking pin 370, the first elastic member 380 will drive the first locking pin 370 to press against the outer side of the rotating base 310 until the first locking pin 370 is inserted into the other locking slot 313, at which time the direction of the chair back assembly is automatically locked. With the above structure, the chair back assembly will not rotate at will, and can only rotate when the first locking pin 370 is pulled out, and the gear can be automatically locked after rotation. The chair back assembly can rotate or be fixed in position, and has a simple structure and good safety.

Specifically, four locking slots 313 are evenly distributed around the outer side of the rotating base 310. The first elastic member 380 is a spring, and the first locking pin 370 is provided with a baffle. One end of the spring abuts against the baffle, and the other end thereof abuts against the upper limit member 330, so as to exert an elastic force on the first locking pin 370. It is conceivable that two, three, or more locking slots 313 can be arranged around the outer side of the rotating base 310, and the first elastic member 380 can also be a spring piece, a torsion spring or a rubber block, etc., which can be specifically configured by a person skilled in the art according to actual needs.

Specifically, a first handle 390 is provided at an outer end of the first locking pin 370 to facilitate the user to pull out the first locking pin 370 by means of the first handle 390, resulting in a simple structure and easy implementation.

Specifically, the moving direction of the first locking pin 370 is in the radial direction of the rotating base 310, so that when the first locking pin 370 is inserted into the locking slots 313, the positioning effect of the upper limit member 330 and the rotating base 310 is relatively good. It is conceivable that the moving direction of the first locking pin 370 can also be inclined relative to the radial direction of the rotating base 310, which can be specifically configured by a person skilled in the art according to actual needs.

In an embodiment, the tripod assembly 100 includes a tripod main body 110, a sliding table 120 and a positioning mechanism 130. The tripod main body 110 is provided with two guide tubes 111, and the sliding table 120 is provided with guide assemblies in one-to-one sliding fit with the guide tubes 111. The guide assemblies include sliding sleeves 121 and two sliding fittings 122. The two sliding fittings 122 are spaced apart from each other in the sliding sleeves 121. The sliding fittings 122 are provided with through holes in sliding fit with the guide tubes 111, and the adjacent sliding fittings 122 are arranged with a spacing area formed therebetween. The positioning mechanism 130 includes second locking pins 131 and two positioning holes 132. The positioning holes 132 are arranged on the guide tubes 111. The second locking pins 131 are slidably arranged on the sliding sleeve 121 and located in the spacing area, and can be inserted into or pulled out of the positioning holes 132 to lock or unlock a position of the sliding table 120 relative to the tripod main body 110. The rotating mechanism 300 is connected to the sliding table 120.

The two sliding fittings 122 are spaced apart from each other in the sliding sleeve 121, so that the sliding table 120 can be more stable when sliding relative to the tripod main body 110. When the second locking pin 131 is inserted into the positioning hole 132, the sliding table 120 cannot slide relative to the tripod main body 110, thereby fixing the position of the seat assembly 200 relative to the tripod assembly 100. After the second locking pin 131 is pulled out of the positioning hole 132, the positions of the sliding table 120 and the seat assembly 200 can be moved to meet different usage requirements and have good safety.

Specifically, a mounting plate is provided around the outer side of the rotating base 310, and the mounting plate is connected to the sliding table 120 in a threaded manner by means of screws, so as to be mounted and fixed on the sliding table 120. It is conceivable that the rotating base 310 can also be connected to the sliding table 120 by means of welding, or fixed to the sliding table 120 by means of riveting.

Specifically, two sliding sleeves 121 are located at opposite ends of the sliding table 120, and are connected by means of reinforcing rods, so that the sliding table 120 has a relatively strong structure.

In an embodiment, the sliding fittings 122 are linear bearings, and the guide assembly is provided with two sliding fittings 122, and the two sliding fittings 122 are respectively arranged at opposite ends of the sliding sleeve 121. By arranging the two sliding fittings 122 at both ends of the sliding sleeve 121, the sliding table 120 is not prone to sideways deflection when sliding to both ends of the guide tube 111, and the seat assembly 200 has better stability when sliding. The sliding fittings 122 are linear bearings, so that the seat assembly 200 slides relatively effortlessly and the noise is reduced. It is conceivable that the sliding fittings 122 may not be arranged at the opposite ends of the sliding sleeve 121. The sliding fittings 122 can also adopt other structures, such as nylon sleeves, which also have better sliding effects.

Specifically, the sliding fittings 122 are fixed in the sliding sleeve 121 by means of a retaining spring. It can be understood that the sliding fittings 122 can also be fixed in the sliding sleeve 121 by means of, for example, screw locking.

Specifically, the tripod main body 110 is provided with two guide tubes 111, so that the sliding table 120 can slide relatively smoothly and the structure of the tripod assembly 100 is simplified. It is conceivable that the tripod main body 110 can also be provided with only one guide tube 111. In this case, the guide tube 111 can be a flat oval tube, which can also make the seat assembly 200 relatively stable. Alternatively, the tripod main body 110 can also be provided with three or more guide tubes 111, which can be specifically configured by a person skilled in the art according to actual needs.

Specifically, the positioning mechanism 130 includes second locking pin 131 and two positioning holes 132. The guide tubes 111 are provided with two positioning holes 132 spaced apart from each other in the length direction, so that the sliding table 120 can be positioned at different locations relative to the tripod main body 110 to meet different usage needs. It is conceivable that the positioning mechanism 130 can also include one or more positioning holes 132, so that the sliding table 120 can be positioned at a designated position by means of the second locking pin 131. Two or more second locking pins 131 can be arranged to improve the firmness when positioning the sliding table 120.

In an embodiment, the positioning mechanism 130 also includes a second elastic member 133, which is arranged between the second locking pin 131 and the sliding sleeve 121 and can drive the second locking pin 131 to press against the outer sides of the guide tubes 111. After the second locking pin 131 is pulled out of the positioning holes 132, the sliding table 120 is moved in the guide tubes 111 to adjust the position of the seat assembly 200. During this period, the second locking pin 131 can be released. Under the action of the second elastic member 133, the second locking pin 131 continue to press against the outer sides of the guide tubes 111. When the sliding table 120 slides until the second locking pin 131 passes through the positioning hole 132, the second elastic member 133 will automatically drive the second locking pin 131 to be inserted into the positioning hole 132 to achieve automatic locking of the sliding table 120 and the seat assembly 200, which facilitates the seat assembly 200 to form a function similar to position and gear adjustment, and has a simple structure and better safety.

Specifically, the second elastic member 133 is a spring. The sliding sleeve 121 is provided with locking pin guide tubes 134 in the radial direction. The outer end of the locking pin guide tube 134 is provided with a closing structure. The second locking pin 131 includes connecting shafts and bolt heads with an outer diameter larger than that of the connecting shafts. The second locking pin 131 passes through the locking pin guide tubes 134. The closing structure allows the connecting shafts to pass through and restricts the passage of the bolt heads. Springs are sleeved on the outer sides of the connecting shafts and located in the locking pin guide tubes 134. One ends of the springs abut the closing structure, and the other ends thereof abut against the bolt heads, thereby providing the second locking pin 131 with an elastic force toward the guide tubes 111. The locking pin guide tubes 134 are arranged to facilitate guiding the sliding direction of the second locking pin 131 accurately. When the second locking pin 131 is pulled out of the positioning hole 132, the structure of the second locking pin 131 limits the pullout range of the second locking pin 131, which prevents the second locking pin 131 from accidentally detaching from the locking pin guide tubes 134, and thus has good use stability.

Specifically, a second handle 140 is connected to the end of the second locking pin 131 away from the guide tubes 111. The second handle 140 can facilitate pulling out the second locking pin 131, and can also limit the positions of the second locking pin 131 for ease of use. The second handle 140 can be connected to the end of the second locking pin 131 by means of threaded connection, or can be connected to the end of the second locking pin 131 by means of welding.

Specifically, the sliding sleeves are provided with mounting holes 123. The hole axis of the mounting holes 123 is coaxial with the central axis of the locking pin guide tubes 134, and the second locking pin 131 can be mounted into the locking pin guide tubes 134 through the mounting holes 123. After the second locking pin 131 are coated with springs, the second locking pin 131 penetrate the locking pin guide tubes 134 from the installation holes 123 and extend the connecting shafts of the second locking pin 131 out of the closing structure. At this time, the second handle 140 is mounted to the end of the connecting shafts to limit the movement stroke of the second locking pin.

Specifically, the locking pin guide tube 134 is provided with an extension section toward the inner side of the sliding sleeve 121 to further improve the accuracy of the movement trajectory of the second locking pin 131.

Specifically, limit members are provided at both ends of the guide tubes 111 for limiting the sliding range of the sliding table 120. The limit members are screws, which are connected to the guide tubes 111 in a threaded manner. The heads of the screws can stop the sliding fittings 122, thereby limiting the maximum sliding range of the sliding table 120.

In an embodiment, the tripod main body 110 includes a connecting frame and four legs 150. The connecting frame is provided with an insertion rod. The legs 150 are provided with insertion holes that are in insert-fitting with the insertion rod, and the legs 150 are detachably inserted into the connecting frame. When the bath chair needs to be transported or stored, the four legs 150 can be detached from the connecting frame, thereby reducing the storage space of the bath chair and facilitating storage and transportation.

Furthermore, the insertion rod is provided with a spring pin, and the legs 150 are provided with a plurality of spring pin holes arranged in the length direction of the insertion holes. The spring pin is inserted into one of the gear holes, and the spring pin can be switched and inserted into different gear holes to adjust the overall height of the bath chair. On this basis, thus the bath chair is flexible to be used.

Specifically, when the height of the bath chair needs to be adjusted, the spring pin is pressed away from one gear hole. In this case, the legs 150 can be pulled out relative to the connecting frame until the spring pin is automatically inserted into another gear hole, realizing height gear adjustment of the bath chair at this point.

Specifically, the legs 150 are provided with five gear holes. On this basis, the bath chair can be height-adjusted in five gears. It is conceivable that the legs 150 can also be provided with two, three, or more gear holes, which can be specifically configured by a person skilled in the art according to actual needs. The spring pin is a common structure on the market and will not be described in detail here.

In the description of the present specification, description of reference terms such as "one embodiment", "some embodiments", "illustrative embodiments", "examples", "specific examples", or "some examples" implies that specific characteristics, structures, materials or features described in conjunction with the embodiments or examples are included in at least one embodiment or example of the present disclosure. In the present specification, the schematic expression of the above terms does not necessarily refer to the same embodiment or example. Moreover, the specific characteristics, structures, materials or features described can be combined in any one or more embodiments or examples in a suitable manner.

Although the embodiments of the present disclosure have been shown and described, a person of ordinary skill in the art can understand that various changes, modifications, substitutions and variations can also be made to these embodiments without departing from the principle and purpose of the present disclosure, and the scope of the present disclosure is defined by the claims and their equivalents.

What is claimed is:

1. A rotatable bath chair, comprising:

a tripod assembly;

a seat assembly, located above the tripod assembly; and a rotating mechanism, arranged between the tripod assembly and the seat assembly, the rotating mechanism comprising a rotating base, a rotating shaft, an upper limit member and a first plane support assembly, wherein the upper limit member is connected to an upper end of the rotating shaft, the upper limit member is arranged on the seat assembly, the rotating base is arranged on the tripod assembly, the rotating shaft passes through the rotating base in a vertical direction, the first plane support assembly is arranged between the upper limit member and the rotating base; and wherein the first plane support assembly comprises a first upper ring, a first rolling member and a first lower ring which are arranged vertically, the first upper ring abuts against the upper limit member, the first lower ring abuts against the rotating base, and the first rolling member is arranged between the first upper ring and the first lower ring.

2. The rotatable bath chair according to claim 1, wherein the upper limit member is spaced apart from an upper end of the rotating base.

3. The rotatable bath chair according to claim 2, wherein the rotating base has an upper part provided with an upper accommodating hole, the upper accommodating hole has a hole axis arranged in the vertical direction, the first plane support assembly is arranged in the upper accommodating hole, the first lower ring abuts against a bottom of the upper accommodating hole, and the upper accommodating hole has a depth less than an axial dimension of the first plane support assembly.

4. The rotatable bath chair according to claim 1, wherein the rotating mechanism comprises a lower limit member and a second plane support assembly; the lower limit member is located below the rotating base and connected to the rotating shaft, the second plane support assembly is arranged between the lower limit member and the rotating base, the second plane support assembly comprises a second upper ring, a second rolling member and a second lower ring which are arranged vertically, the second upper ring abuts against the rotating base, the second lower ring abuts against the lower limit member, and the second rolling member is arranged between the second upper ring and the second lower ring.

5. The rotatable bath chair according to claim 4, wherein the lower limit member is spaced apart from a lower end of the rotating base.

6. The rotatable bath chair according to claim 5, wherein the rotating base has a lower part provided with a lower accommodating hole, the lower accommodating hole has a hole axis arranged in the vertical direction, the second plane support assembly is arranged in the lower accommodating hole, the second upper ring abuts against a bottom of the lower accommodating hole, and the lower accommodating hole has a depth less than an axial dimension of the second plane support assembly.

7. The rotatable bath chair according to claim 1, wherein the rotating mechanism comprises a first locking pin and a first elastic member; the rotating base is provided with at least two locking slots at outer side thereof and around a rotating axis of the rotating shaft, the first locking pin is slidably arranged below the upper limit member and is capable of being inserted into or pulled out of the locking slots, and the first elastic member is arranged between the first locking pin and the upper limit member and is capable of driving the first locking pin to press against the outer side of the rotating base.

8. The rotatable bath chair according to claim 1, wherein the tripod assembly comprises a tripod main body, a sliding table and a positioning mechanism; the tripod main body is provided with at least one guide tube, the sliding table is provided with a guide assembly in one-to-one sliding fit with the guide tube, the guide assembly comprises a sliding sleeve and at least two sliding fittings, the at least two sliding fittings are spaced apart from each other in the sliding sleeve, the sliding fittings are provided with through holes in sliding fit with the guide tube, and the sliding fittings are arranged with a spacing area formed therebetween, and wherein the positioning mechanism comprises at least one second locking pin and at least one positioning hole, the positioning hole is arranged on the guide tube, the second locking pin is slidably arranged on the sliding sleeve and located in the spacing area, the second locking pin is capable of being inserted into or pulled out of the positioning hole to lock or unlock a position of the sliding table relative to the tripod main body, and the rotating mechanism is connected to the sliding table.

9. The rotatable bath chair according to claim 8, wherein the sliding fittings are linear bearings, and the guide assembly is provided with two sliding fittings, and the two sliding fittings are respectively arranged at opposite ends of the sliding sleeve.

10. The rotatable bath chair according to claim 8, wherein the positioning mechanism comprises a second elastic member arranged between the second locking pin and the sliding sleeve, and the second elastic member is capable of driving the second locking pin to press against an outer side of the guide tube.

* * * * *